United States Patent [19]

Holtvogt

[11] 4,251,047

[45] Feb. 17, 1981

[54] SWIVEL HOLD-DOWN DEVICE

[75] Inventor: Joseph D. Holtvogt, Miamisburg, Ohio

[73] Assignee: The Dayton Sure Grip & Shore Company, Miamisburg, Ohio

[21] Appl. No.: 60,063

[22] Filed: Jul. 24, 1979

Related U.S. Application Data

[63] Continuation of Ser. No. 648,487, Jan. 12, 1976, abandoned.

[51] Int. Cl.[3] ..... B28B 23/06

[52] U.S. Cl. ..... 249/205; 52/226; 249/91; 249/207; 249/210; 264/228; 425/111

[58] Field of Search ..... 52/225, 226; 264/228; 425/111; 249/91, 207, 210, 205; 254/51; 248/55, 58, 59

[56] References Cited

U.S. PATENT DOCUMENTS

| | | | |
|---|---|---|---|
| 3,091,897 | 6/1963 | Hillberg | 52/225 |
| 3,106,803 | 10/1963 | McRobbie | 248/59 |
| 3,286,419 | 11/1966 | Eriksson | 425/111 X |
| 3,831,331 | 8/1974 | Colado | 52/225 |
| 3,854,258 | 12/1974 | Colado et al. | 425/111 X |

OTHER PUBLICATIONS

"Hold Down Anchors"; Superior Concrete Accessories, Inc., Dec. 2, 1957.

*Primary Examiner*—Thomas P. Pavelko
*Attorney, Agent, or Firm*—Biebel, French & Nauman

[57] ABSTRACT

A hold-down anchor device for securing reinforcing strands in a mold while the strands are tensioned, the mold filled with concrete, and the concrete allowed to set, is held in place by an anchor means traversing the mold wall. The hold-down anchor device includes a pair of side frame elements which are disposed parallel to each other and positioned generally vertically in the mold. A number of strand hold-down means extend transversely between the side frame elements. A swivel means is pivotally secured to the lower ends of the side frame elements and includes means for engaging the anchor means. The swivel means further includes means for retaining one or more reinforcing strands near the lower ends of the side frame elements in corresponding closely spaced relation with the mold. The swivel means may include either grooves or rollers for retaining the reinforcing strands near the lower ends of the side frame elements.

7 Claims, 7 Drawing Figures

SWIVEL HOLD-DOWN DEVICE

This is a continuation of application Ser. No. 648,487, filed Jan. 12, 1976, now abandoned.

BACKGROUND OF THE INVENTION

The present invention relates to a hold-down anchor device for securing the reinforcing strands of a prestressed concrete building element in a mold while the strands are tensioned, the mold filled with concrete, and the concrete allowed to set. It is known that the strand characteristics of a concrete building element, such as an I-beam girder, may be improved by embedding strands or cables within the concrete. Also, it is known to tension the strands prior to pouring the concrete, thereby increasing the strength characteristics of the element.

A typical strand configuration in an I-beam girder is one in which the strands extend inwardly and downwardly from the upper portion of one end of the girder and pass on an incline through the web portion and into the base portion of the girder where the strands are engaged by a hold-down device. The strands then extend horizontally along the base portion to a second hold-down device from which they extend upwardly and outwardly into the head portion of the opposite end of the girder.

The reinforcing strands of such an element are placed under a great deal of tension, and a hold-down device used with a number of such strands, therefore, is required to handle large static forces. Typically hold-down devices are designed to handle large lift forces, e.g. 5000 pounds per strand, which tend to pull the strands from the girder base portion of an element mold. Lateral forces creating a bending moment about an anchor bolt securing the hold-down device to the wall of the mold will quite often damage the bolt or the hold-down device, however. In order to overcome this problem, a swiveling hold-down, such as shown in U.S. Pat. No. 3,854,258, issued Dec. 17, 1974 to Colado et al, has been used. With such a design, the hold-down may swivel at its base to assume an inclined position in which the upward thrust on the cables is along the length of the hold-down. That is, the angle of incidence of each cable with respect to the hold-down equals the angle of emergence so that the force moment which is created about the anchor bolt of the hold-down device is minimized.

A variation of this design is shown in U.S. Pat. No. 3,831,331, issued Aug. 27, 1974, to Colado. In that device, a metal cylinder has a threaded opening for engaging an anchor bolt and also provides a pivot for the hold-down. A central opening in the cylinder beneath the pivot allows an additional cable to be secured.

One disadvantage of previously known pivoting hold-down devices has been that the reinforcing strands could not be positioned as close to the mold wall as might be desired. Specifically, it is desired to maintain a predetermined minimum distance in the finished building element between the surface of the element and any metallic member, either a strand or a part of the hold-down unit. This results in an element having superior fire resistant characteristics, as well as substantial immunity from rusting. With previously known hold-down devices, however, maintaining this minimum distance has resulted in the cables being positioned a substantially greater distance from the surface of the building element.

SUMMARY OF THE INVENTION

In accordance with the present invention, a hold-down anchor device, engageable by an anchor means traversing a mold wall, is provided for holding reinforcing strands of a prestressed concrete building element in position. The hold-down anchor device includes a pair of side frame elements which are disposed parallel to each other and positionable generally vertically in the mold. A plurality of strand hold-down means extend transversely between the side frame elements. A swivel means is pivotally secured to the lower ends of the side frame elements.

This swivel means has a means for engaging the anchor means and further comprises means for retaining the reinforcing strands near the lower ends of the side frame elements such that the strands are at least as low as the projection of the side frame elements below the swivel means. The anchor means may comprise a threaded anchor bolt and the means for engaging the anchor means may comprise a threaded transverse opening in the swivel means for receiving the threaded anchor bolt. The means for retaining the reinforcing strands may comprise grooves in the surface of the swivel means. Alternatively, the swivel means may comprise a central portion defining a threaded opening for engaging the anchor bolt and integral axle portions journalled in the side frame elements. Grooved rollers are journalled on each of the axle portions for retaining the two reinforcing strands.

In another embodiment, the anchor means comprises two threaded anchor bolts, and the means for engaging the anchor means may comprise two threaded transverse openings in the swivel means.

Accordingly, it is an object of this invention to provide a hold-down anchor device which is pivotable about a swivel engaged by an anchor means extending through a mold wall and which includes means for positioning reinforcing strands near the mold wall while maintaining a predetermined minimum clear distance from the mold wall; and to provide such a device in which the swivel arrangement includes means for retaining the reinforcing strands.

Other objects and advantages of the invention will be apparent from the following description, the accompanying drawings and the appended claims.

DETAILED DESCRIPTION OF THE INVENTION

Figure 1:
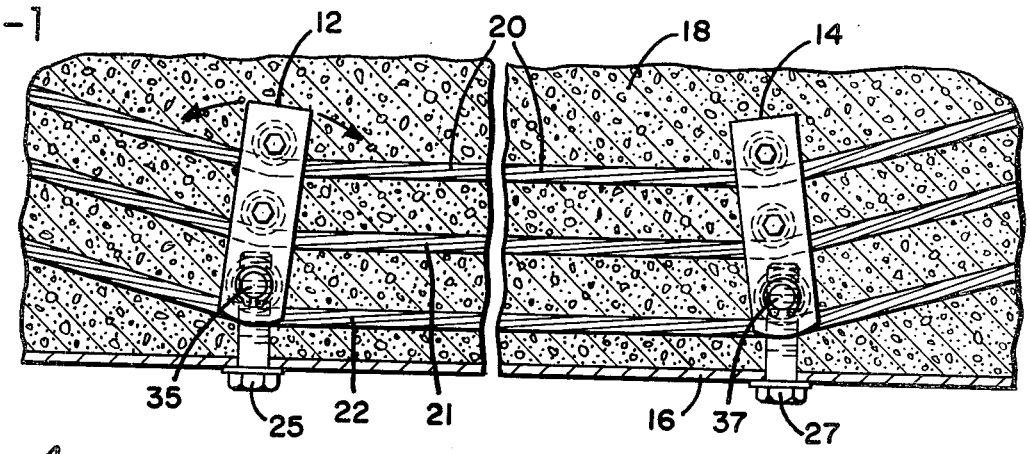
FIG. 1 is a fragmentary sectional view taken substantially centrally and longitudinally through a concrete building element form, showing a pair of hold-down anchor devices of the present invention.

Referring now to FIG. 1, two hold-down anchor devices 12 and 14 of the embodiment of the present invention are shown as installed in a concrete building element. Typically a building element such as an I-beam girder is formed in a mold 16 into which concrete 18 is poured after reinforcing strands 20, 21 and 22 have been positioned and tensioned. The hold-down devices 12 and 14 are held in position by anchor means, shown here as anchor bolts 25 and 27, respectively, which extend through the wall of mold 16.

The hold-down anchor devices may pivot about swivel means 35 and 37. This pivoting action is provided in order to prevent the generation of a substantial bending moment about the anchor bolts 25 and 27. When the hold-down anchor devices have pivoted as shown, so that the angle of incidence of each cable 20, 21 and 22 equals the angle of emergence, only an upward force parallel with the hold-down is generated by the reinforcing strands. Bending moments about the hold-down devices or the anchor bolts are thus substantially eliminated.

Figure 2:
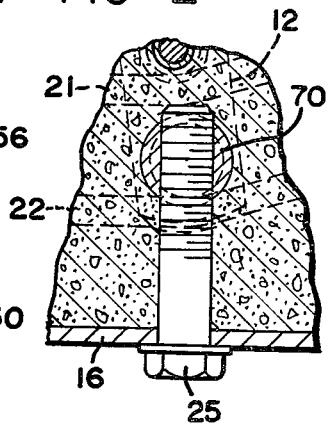
FIG. 2 is a fragmentary sectional view of a threaded anchor bolt engaging a hold-down anchor device of the present invention.
Figure 3:
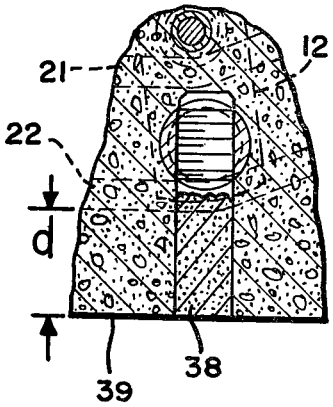
FIG. 3 is a fragmentary sectional view similar to FIG. 2, but with the anchor bolt removed and grouting inserted.

As shown in FIGS. 2 and 3, the anchor bolts are in place only until the concrete is firmly set. At that point, the bolts are removed along with the mold wall 16 and the resulting holes filled with grouting material 38. As seen in FIG. 3, no metallic part, either the hold-down device 12 or cable 22, is less than a predetermined minimum distance d from a surface 39 of the girder.

Figure 4:
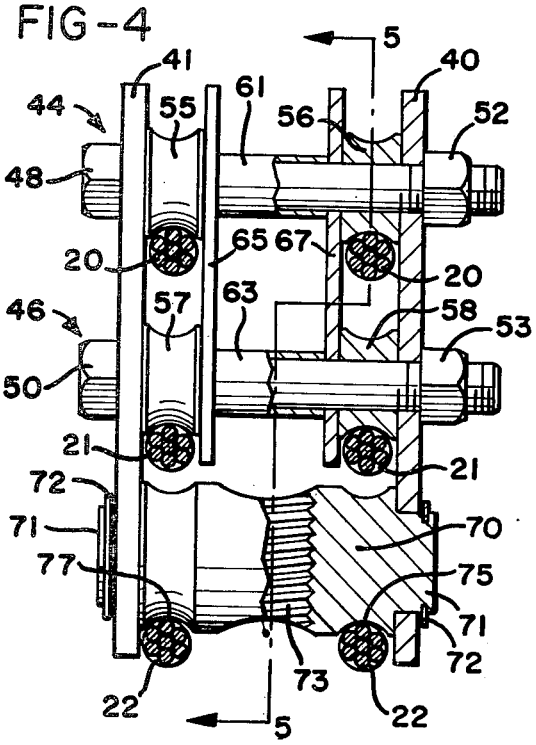
FIG. 4 is an enlarged side elevational view of one embodiment of the present invention with portions broken away and in section.

Referring now to FIG. 4, there is shown a side elevational view of one embodiment of the invention with portions broken away and in section. A pair of side frame elements 40 and 41 are disposed parallel to each other and positionable generally vertically when in a mold. Strand hold-down means 44 and 46 extend transversely between side frame elements 40 and 41. Strand hold-down means 44 and 46 include bolts 48 and 50 which extend through the side frame elements and are secured by nuts 52 and 53, respectively. The strand hold-down means further include rollers 55, 56, 57 and 58 which are mounted on the bolts. Cylindrical spacers 61 and 63 hold restrainer plates 65 and 67 in position adjacent the rollers.

Figure 5:
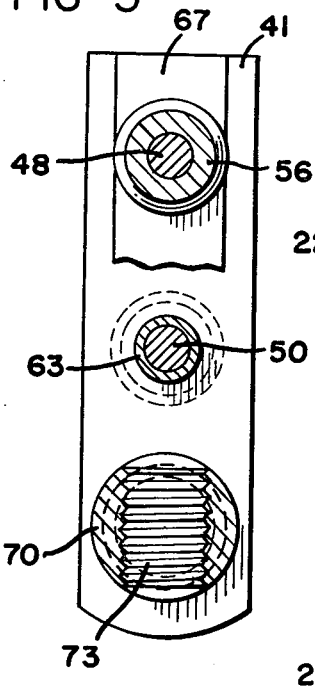
FIG. 5 is a sectional view taken generally along line 5—5 of FIG. 4.

As seen in FIGS. 4 and 5, swivel lug 70 is positioned between and pivotally secured to the lower ends of side frame elements 40 and 41. Swivel lug 70 includes end portions 71 of reduced diameter which are journalled in the side frame elements 40 and 41 and held by retainer rings 72. Swivel means 70 includes means for engaging the anchor means, here shown as a threaded transverse opening 73 which receives and engages an anchor bolt while the building element is being poured.

Swivel lug 70 further includes means for retaining two reinforcing strands 22 near the lower ends of side frame elements 40 and 41. In FIG. 4, this retaining means includes grooves 75 and 77 in the surface of swivel lug 70 between opening 73 and end side frame element. This configuration will carry the necessary loads and also make it possible to position reinforcing strands 22 as close to the surface of a building element as possible while still maintaining the requirement of a concrete insulating coating of a predetermined thickness covering all metallic parts. Thus, after the threaded anchor bolt is removed from the finished building element, the strands 22 will be closer to the surface of the element than the hold-down anchor devices.

Figure 6:
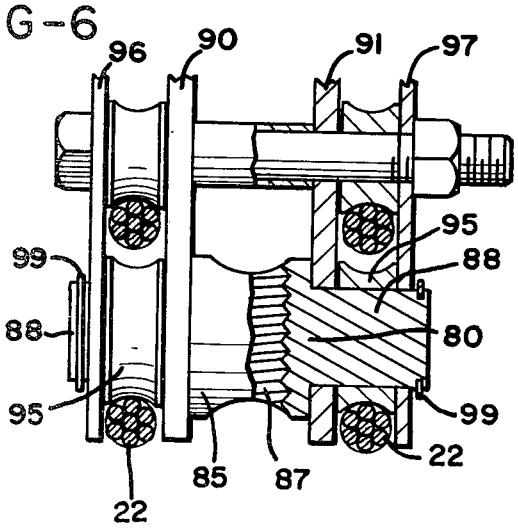
FIG. 6 is an enlarged fragmentary side elevational view of an alternative embodiment of the present invention with portions broken away and in section.

An alternate embodiment of the invention is shown in FIG. 6, which is a partial side elevational view with portions in section. The swivel means 80 is a lug having a central portion 85 containing threaded opening 87 for engaging an anchor bolt. Swivel lug 80 further includes integral axle portions 88 which are journalled in side frame elements 90 and 91 and project therebeyond. Grooved rollers 95 are journalled on these projecting axle portions 88 and are held thereon by retainer plates 96 and 97 and retainer rings 99. The embodiment shown in FIG. 6 is satisfactory for use in many installations wherein the tensioning of the strands 22 is not too high. For heavy loading, however, it is preferable to use the construction of FIG. 4 wherein the swivel lug is of greater diameter in its portions which transmit the loads to the anchor bolt.

Figure 7:
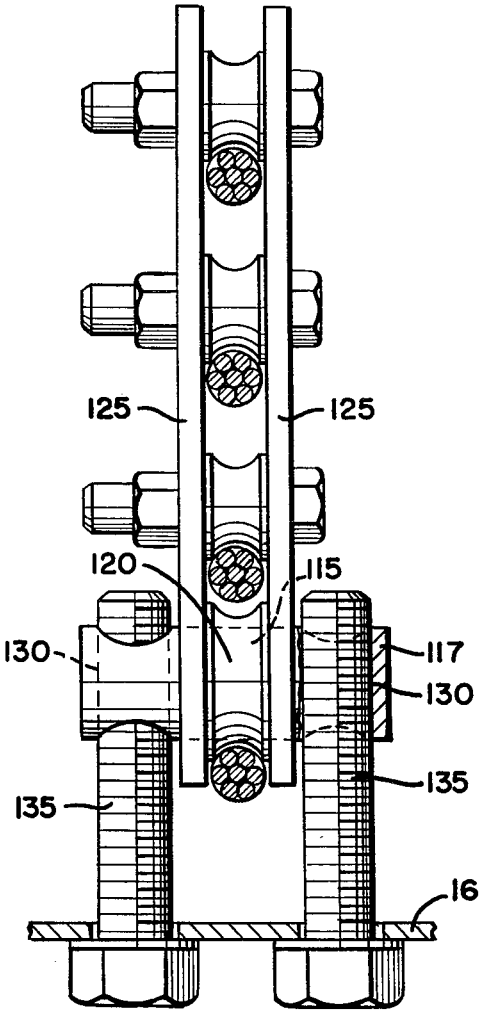
FIG. 7 is a side elevational view of a further embodiment of the present invention.

A further embodiment of the invention is shown in FIG. 7, which is a side elevational view. Swivel means 115 is a lug 117 having a central portion upon which is journalled roller 120. Lug 117 is journalled in side frame elements 125 and projects therebeyond. Lug 117 defines threaded openings 130 which engage anchor bolts 135. This embodiment is used where only one row of reinforcing strands is to be held.

While the forms of apparatus herein described constitute preferred embodiments of the invention, it is to be understood that the invention is not limited to these precise forms of apparatus, and that changes may be made therein without departing from the scope of the invention.

What is claimed is:

1. A hold-down anchor device, engageable by a threaded anchor member traversing a mold wall, for holding the reinforcing strands of a prestressed concrete building element in position in the mold while the strands are tensioned, the mold filled with concrete, and the concrete allowed to set, said anchor device remaining embedded in the building element after the threaded anchor member is removed and the resulting void grouted, comprising:

a pair of side frame elements disposed parallel to each other and positionable generally vertically in the mold, a plurality of strand hold-down means extending transversely between said side frame elements, and a substantially cylindrical swivel means pivotally secured to the lower ends of said side frame elements and having a threaded transverse opening therein for receiving said threaded anchor member, said side frame elements projecting below said swivel means, said swivel means further defining a pair of grooves extending circumferentially therearound for retaining bottom reinforcing strands near said ends of said side frame elements, said grooves positioned to either side of said threaded transverse opening, such that said bottom strands are beneath said swivel means and are at least as low as the projection of said side frame elements below said swivel means, said bottom strands being held closer to said mold wall than said swivel means and at least as close to said mold wall as said side frame elements, whereby the concrete forming said building element provides thermal insulation for said bottom strands to provide a building element having superior fire resistant characteristics and substantial immunity from rusting, and said anchor device is no closer to the surface of said building element than said bottom strands after said void is grouted.

2. The anchor device of claim 1 in which said grooves defined by said swivel means are positioned between said threaded transverse opening and each of said side frames.

3. The anchor device of claim 1 in which said swivel means further comprises:

a central portion defining said threaded opening for engaging said anchor bolt, integral axle portions journalled in said side frame elements, and in which said grooves are defined by grooved rollers journalled on each of said axle portions, and positioned outwardly from said side frame elements.

4. The anchor device of claim 3 in which said integral axle portions have a diameter less than that of said central portion.

5. The anchor device of claim 3 in which said integral axle portions extend outwardly from said central portion on opposite sides thereof.

6. A hold-down anchor device, engageable by a pair of threaded anchor members traversing a mold wall, for holding the reinforcing strands of a prestressed concrete building element in position in the mold while the strands are tensioned, the mold filled with concrete, and the concrete allowed to set, said anchor device remaining embedded in the building element after the threaded anchor members are removed and the resulting voids grouted, comprising:

a pair of side frame elements disposed parallel to each other and positioned generally vertically in the mold, a plurality of strand hold-down means extending transversely between said pair of side frame elements, and a substantially cylindrical swivel means pivotally secured to the lower ends of said side frame elements and having a pair of threaded transverse openings therein for receiving said threaded anchor members, said side frame elements projecting below said swivel means, said swivel means further defining a groove extending circumferentially therearound for retaining a bottom reinforcing strand near said ends of said side frame elements, said groove positioned between said side frame elements, and said threaded transverse openings positioned outwardly to either side of said side frame elements, such that said bottom strand is beneath said swivel means and is at least as low as the projection of said side frame elements below said swivel means, said bottom strand being held closer to said mold wall than said swivel means and at least as close to said mold wall as said side frame elements, whereby the concrete forming said building elements provides thermal insulation for said bottom strand to provide a building element having superior fire resistant characteristics and substantial immunity from rusting, and said anchor device is no closer to the surface of said building element than said bottom strand after said voids are grouted.

7. The hold-down anchor device of claim 6 in which said swivel means includes a grooved roller between said side frame elements defining said circumferentially extending groove.

* * * * *